US006524779B1

(12) United States Patent
Fyson et al.

(10) Patent No.: US 6,524,779 B1
(45) **Date of Patent: *Feb. 25, 2003**

(54) METHOD OF PRODUCING A PHOTOGRAPHIC IMAGE

(75) Inventors: John R. Fyson, London (GB); Gareth B. Evans, Potten End (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/857,089

(22) PCT Filed: Dec. 20, 1999

(86) PCT No.: PCT/GB99/04319

§ 371 (c)(1),
(2), (4) Date: May 31, 2001

(87) PCT Pub. No.: WO00/38010

PCT Pub. Date: Jun. 29, 2000

(30) Foreign Application Priority Data

Dec. 19, 1998 (GB) ..... 9827979

(51) Int. Cl.[7] ..... G03C 7/407
(52) U.S. Cl. ..... 430/404
(58) Field of Search ..... 430/404

(56) References Cited

U.S. PATENT DOCUMENTS 4,450,222 A * 5/1984 Mattes et al. ..... 430/220

OTHER PUBLICATIONS

Abstract of JP 361219949, Sep. 30, 1986.*
Abstract of WO9117478, Nov. 14, 1991.*
Abstract of EP566181, Oct. 20, 1993.*

* cited by examiner

*Primary Examiner*—Hoa Van Le

(57) ABSTRACT

A method of producing a photographic image in an imagewise exposed photographic material comprising one or more silver halide emulsion layers is provided which method comprises developing the material with a developer solution containing a silver halide developing agent, releasably laminating the material with a receiver sheet containing an adsorbent for the developing agent in oxidized and unoxidized form, and, after a period of time sufficient for adsorption of the developing agent in the receiver sheet, separating the photographic material and the receiver sheet.

11 Claims, 1 Drawing Sheet

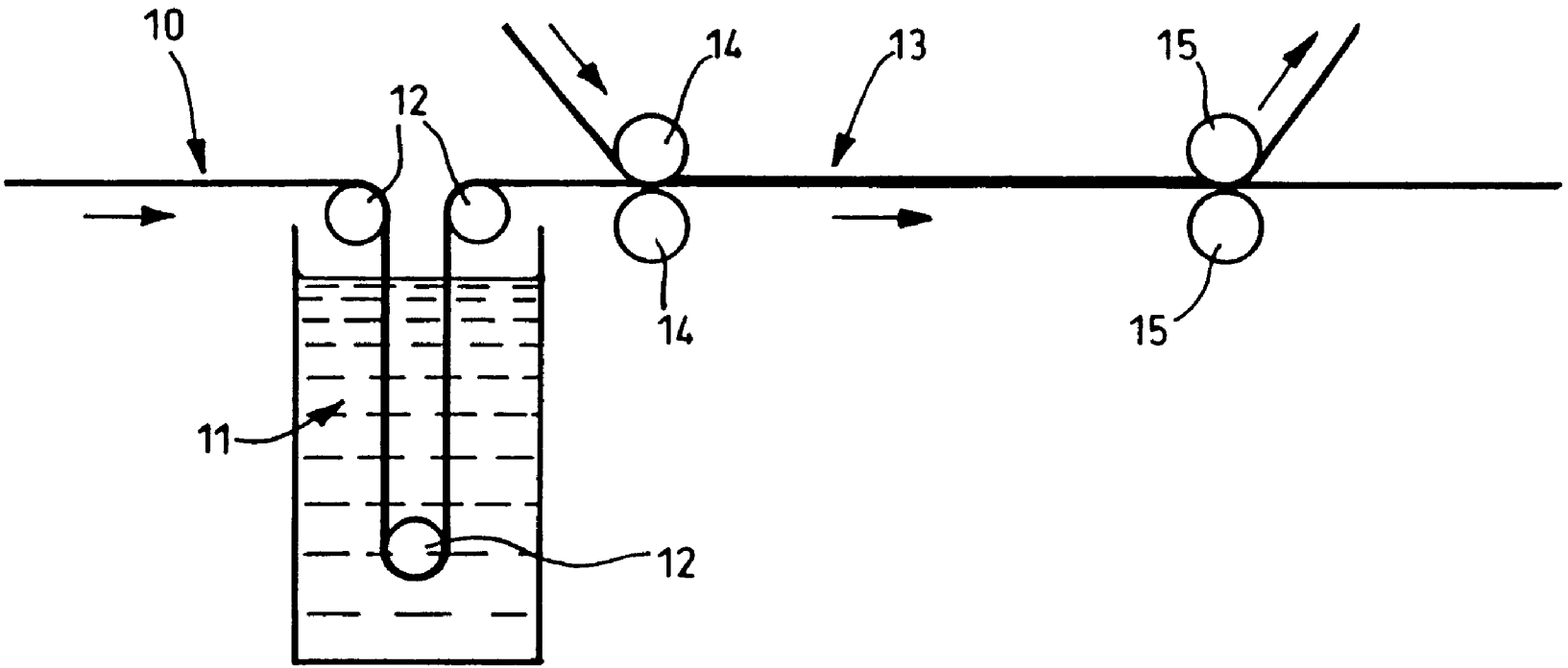
10
11
12
12
13
14
14
15
15

METHOD OF PRODUCING A PHOTOGRAPHIC IMAGE

FIELD OF THE INVENTION

This invention relates to the processing of silver halide photographic materials. In particular, the invention simplifies chemical processing and reduces the volumes of liquid processing solutions employed. It applies to transparent film and reflection print materials, both colour materials and black and white materials. It is particularly useful where early stages in the processing sequence produce little or no effluent.

BACKGROUND OF THE INVENTION

Normally, silver halide materials are processed in equipment with deep tanks containing processing solutions. The solutions need to be maintained in a chemically stable state to the extent that uniformity and consistency of photographic results are assured.

The effects of evaporation, interaction with atmospheric gases such as oxygen and carbon dioxide, and the effects of processing usually have to be compensated for by replenishment techniques. This requires operator intervention and/or the provision of additional solutions and means of adding them accurately. Also, liquid effluent is produced which has to be disposed of in a safe and cost-effective way. These wet chemical systems are generally difficult to keep clean.

Most currently used processes for silver halide films and papers involve several deep-tank stages including the development step, a bleach step where metallic developed silver is usually converted to silver halide, and a fixing step where the silver halide remaining undeveloped and any silver halide formed by bleaching is dissolved using a substance capable of complexing with silver ions to produce a soluble silver compound. This is usually washed out of the processed material in a washing or stabilisation stage. Sometimes the bleach and fix steps are combined. In the case of most black and white materials the bleach step is avoided.

Photographic colour paper materials usually use silver halide in sufficient quantity to produce all the oxidised developer in the process of development which is necessary to produce sufficient dye for satisfactory image densities. Low silver materials have also been described which use small fractions of the amount of silver needed to provide the image dye via, for example, reaction with colour-forming couplers. These low-silver materials are processed in the presence of oxidising agents such as hydrogen peroxide in so-called Redox Amplification or RX processes. In such processes the developed silver image is used to catalyse in an image-wise manner, the production of oxidised developer and hence, image dye. Such materials are appropriate for the production of prints.

It is possible to leave the developed silver in the image with little effect on image quality when very low amounts of silver halide are used Research Disclosure September 1997 p.638). In some circumstances it is actually desirable to leave the developed silver in the image areas. For example, a simpler process can be used when the bleach step is avoided. Also, it may be useful to leave silver in the image so that it can be used with automatic image detection systems which use infra-red light to detect the image.

It has also been suggested that it is possible to leave the silver halide in non-image areas. This retained silver halide can be stabilised to degradation by light for example by destroying the silver halide spectral sensitising dyes by exposure to light (U.S. Pat. No. 5,441,843) or by converting the silver halide to a more stable form such as silver iodide (U.S. Pat. No. 5,246,822).

There is still a possibility however, that degradation of non-image areas and those areas of low density can be degraded by atmospheric sulphur compounds which may convert the halide into the highly coloured silver sulphide over time so some eventual degradation to sulphide must be anticipated. This limits the amounts of silver which can be tolerated in the resulting colour images, i.e. it limits the amounts coated unless it can be removed. It is known that reductions in the number of silver centres and hence, dye clouds which contribute to image density lead to dye hue being degraded and image graininess being increased (G. B. Evans et. al., Proceedings of the ICPS Symposium, Antwerp, September 1998, p149). For high quality images where these effects are small or negligible, sufficient image centres must be used. This means that without reductions in silver halide crystal sizes which would lower photographic speed, sufficient silver must be used to provide the necessary number of image centres.

Image transfer materials are known in which undeveloped silver is solubilised by fixing agents and deposited from solution in the presence of the developing agent, onto nuclei which catalyse the conversion of silver ions to silver metal. This process is used to produce positive silver images in the material to which the silver ions are transferred ("The Theory of the Photographic Process" ed. James, T. H. H., $4^{th}$ Edition p 471).

Photographic processes usually involve a final washing stage to remove dissolved "fixed" silver and other materials which would cause images to be modified over time, particularly by increasing density in low density areas.

Lamination methods have been described in which silver halide is solubilised and transferred from the processed photographic layers to the lamination material where it can be trapped as a result of a chemical process. For example, U.S. Pat. No. 5,478,703 discloses that the silver can exchange with metallic aluminium in a fixer sheet to form silver metal and release aluminium ions. It also discloses that the fixer sheet may contain substances which can react with and immobilise or render harmless colour developing agents, oxidised colour developing agents and bleaching agents.

Problem to be Solved by the Invention

Wet chemical systems of processing are complicated by the means necessary to maintain them at a consistent performance level. Also, they are difficult to keep clean. They produce liquid effluent which requires disposal. Typical photographic processes consist of several treatments in different chemical baths plus a washing or stabilisation stage which is used to remove chemicals which would, if remaining in the image, modify the image over time. The majority of the effluent comes from the wash stages.

The problem to be solved is to provide a means of processing photographic materials in a simple process which minimises or eliminates liquid effluent while ensuring the removal of chemicals which would otherwise modify the images over a period of time. These include not only the organic materials such as colour developer but preferably also unreacted silver halide.

Removal of chemicals using a receiver sheet releasably laminated to the developed photographic material is desirable. In particular, the removal of organic chemicals e.g.

developing agent from the photographic material without requiring a substance in the receiving sheet which will chemically react with it in order to immobilise it or render it harmless would be desirable.

SUMMARY OF THE INVENTION

The present invention provides a method of producing a photographic image in an imagewise exposed photographic material comprising one or more silver halide emulsion layers which method comprises

- developing the material with a developer solution containing a silver halide developing agent,
- releasably laminating the material with a receiver sheet containing an adsorbent for the developing agent in oxidised and unoxidised form, and, after a period of time sufficient for adsorption of the developing agent in the receiver sheet,
- separating the photographic material and the receiver sheet.

Advantageous Effect of the Invention

The invention allows removal of developing agent from the processed photographic material using a receiver sheet which does not require the presence of a substance capable of reacting with the developing agent. The adsorbent used in the invention provides a simpler, less expensive means of removing the developing agent.

In preferred embodiments, the invention avoids the consequences of retaining silver halide in the image and in particular avoids the means, which would otherwise be necessary, of ensuring that the silver halide is not subsequently modified in a way which degrades the image.

The invention also provides a means of trapping silver removed from the imaging material thus providing a convenient means of silver recovery.

The use of RX chemistry may allow very low levels of coated silver whose presence in the image areas as silver and non-image areas as silver halide are tolerable. If photographic speeds are to be maintained at a practical level, such levels of silver result in increased graininess and degraded colour reproduction. This invention allows silver levels sufficient to ensure high quality images to be achieved without the need for a fixing stage and wash stage to be provided by immersion in tanks of solution while still ensuring good image stability.

BRIEF DESCRIPTION OF THE DRAWINGS

The accompanying drawing shows schematically apparatus suitable for performing the invention.

DETAILED DESCRIPTION OF THE INVENTION

The receiver sheet may comprise a layer of the adsorbent suspended in a suitable binder coated on a support. Suitable supports include those used for photographic materials e.g. polymer such as polyester, and paper. Suitable binders include hydrophilic colloid and other binders used in the preparation of photographic emulsion layers. A more detailed description of suitable binders may be found in *Research Disclosure,* September 1994, No. 365, Section IIA. A preferred binder is gelatin.

The adsorbent used in the invention may be chosen from any of the known adsorbents of organic compounds. A particularly preferred adsorbent is carbon e.g. activated carbon, especially activated charcoal. Alternative adsorbents include a range of polymeric materials, for example, the polymers obtained by condensation, such as polyesters, polyamides, polyurethanes, polyethers, epoxy resins, amino resins, phenol-aldehyde resins and acrylic polymers, and polymers derived from ethylenically unsatured monomers such as polyolefins, polystyrene, polyvinyl chloride, and polyvinyl acetate.

For dispersion in a binder, the adsorbents are preferably in particulate form. It is also preferred that the adsorbents are porous.

Particular examples of polymeric adsorbents include cross-linked polystyrene beads and polyacrylic resin beads marketed under the name Amberlite XAD®.

Suitable adsorbents include ion-exchange resins.

In addition to containing an adsorbent to remove organic compounds, the receiver sheet preferably contains a substance for solubilising silver halide and/or a substance capable of converting soluble silver into an insoluble form.

The silver, both developed and undeveloped, in the developed photographic material can be rendered soluble before contact with the receiver sheet by including in the developing solution, or another solution in a subsequent processing step, a means of solubilising the silver. Alternatively, a means of solubilising the silver may be incorporated in the receiver sheet. Examples of silver solubilising compounds include bleaching agents, chelating agents and silver halide solvents. As silver solvents, thiosulphates, thiocyanates, thioether compounds, thioureas , thioglycoloic acid and sulphites can be used. A specific example is hydroxyethyletrahydrotriazole thione (HTTT). A preferred component is thiosulphate e.g. ammonium thiosulphate. Alternative counter ions such as alkali metal ions e.g. lithium, potassium, sodium and caesium may be used.

The silver can be trapped in the receiver sheet by including substances which convert the silver in its soluble form into an insoluble form e.g. silver metal or an insoluble silver compound.

The receiver sheet may contain reducing means capable of forming metallic silver from solubilised silver halide. Examples of suitable reducing means include a metal more electropositive than silver dispersed in the receiver sheet e.g. particles of magnesium, zinc or aluminium. Alternatively, a salt such as zinc sulphide is used and the silver precipitated as silver sulphide. The receiver sheet may contain nuclei on which silver develops to give a metallic deposit.

Between the development step and lamination step, the method of the invention may include a development-stopping step, a bleach step, a fixing step or any combination of such steps. The receiver sheet may also contain a material to stop the development reaction when the lamination occurs.

As mentioned above, the developer solution may contain fixing agent and the receiver sheet may contain the means for converting the silver in its soluble form into an insoluble form e.g. silver metal or an insoluble silver compound.

Aqueous solution carried over from the development step or another step prior to lamination may be sufficient for the desired transfer of substances to the receiver sheet to occur. Preferably, the receiver sheet is soaked in an aqueous solution before lamination. In a preferred embodiment, the aqueous solution is acidic.

The photographic material may be any black and white or colour silver halide material. In a preferred embodiment, the material is a colour print material. A description of typical photographic materials may be found in *Research Disclosure,* September 1997, p. 613, Section I.

Conventional photographic processing steps such as development, bleaching and fixing together with the compositions used in those steps e.g. developing agents are described in, for example, *Research Disclosure,* September 1994, No. 365, Sections XIX & XX and *Research Disclosure,* September 1997, p. 613, Section XXIII.

A preferred form of photographic processing is redox amplification also known as development amplification. Such processes are well known and details may be found in *Research Disclosure,* September 1997, p. 629–630, Section XVI.

The accompanying drawing shows schematically apparatus suitable for performing the invention. A sheet of image-wise exposed photographic material 10 is passed through a developer amplifier solution 11 over stainless steel rollers 12. The developed material is laminated to a receiver sheet 13 by passage between stainless steel rollers 14. The laminated material is passed between another pair of stainless steel rollers 15 and is separated on leaving the rollers into the receiver sheet and the photographic material.

The following examples illustrate the practice of this invention. They are not intended to be exhaustive of all possible variations of the invention. Parts and percentages are by weight unless otherwise indicated.

EXAMPLE 1

The receiver sheet was prepared by suspending 100 g/l 100 mesh activated charcoal in a 10% bone gelatin solution. This was coated onto film base so as to give a carbon laydown of 10 g/m$^2$. The coating was dried and used in this way. The coating was sometimes soaked in an appropriate bath for a short time before lamination to simulate other components being coated.

A similar coating without the carbon was also made.

The photographic material used was a colour paper with a total silver laydown of 84 mg/m$^2$. The material was exposed in a sensitometer at 1/10s through a 0.15 log wedge with correction filters added to try to get a neutral grey scale. The wedge also include red, green and blue separations.

The following solutions were made up to be used in the processes that follow:

| Developer amplifier | |
|---|---|
| Anti-Cal #5 | 0.6 g |
| Anti-Cal #8 | 2.0 g |
| Dipotassium hydrogen phosphate.3$H_2O$ | 40.0 g |
| Hydroxylamine sulphate | 0.5 g |
| CD3 | 4.5 g |
| Water to | 1 litre |
| pH adjusted to 11.7 with sodium hydroxide | |

20 mls 3% hydrogen peroxide was added just before use

Anti-Cal #5 is 1-hydroxy-ethylidene-1,1-diphosphonic acid

Anti-Cal #8 is diethylenetriaminepentaacetic acid, pentasodium salt

CD3 is 4-N-ethyl-N(β-methanesulphonamidoethyl)-o-toluidine sesqisulphate

| Sulphite Fixer | |
|---|---|
| Sodium sulphite (anhydrous) | 50.0 g |
| Sodium acetate | 40.0 g |
| Water to | 1 litre |
| pH adjusted to 7.0 with sulphuric acid | |

| Bleach-fix | |
|---|---|
| Ammonium iron (III) EDTA solution (1.56 M) | 50 mls |
| Ammonium thiosulphate | 50 g |
| Sodium sulphite | 20 g |
| Acetic acid (glacial) | 15 mls |
| Water to | 1 litre |
| pH adjusted to 6.0 | |

| Stop bath | |
|---|---|
| Acetic acid (glacial) | 30 mls |
| Water to | 1 litre |

Any washing was carried out in running fresh water at 35° C.

| Solution 1 | |
|---|---|
| Acetic acid | 50 ml |
| Water to | 1 litre |

| Solution 2 | |
|---|---|
| Acetic acid | 100 ml |
| Water to | 1 litre |

| Solution 3 | |
|---|---|
| Sodium hydrogen sulphite | 100 g |
| Water to | 1 litre |

| Solution 4 | |
|---|---|
| Acetic acid | 100 ml |
| Sodium sulphate | 50 g |
| Water to | 1 litre |

| Solution 5 | |
|---|---|
| Acetic acid | 100 ml |
| Sodium sulphate | 100 g |
| Water to | 1 litre |

| Solution 6 | |
|---|---|
| Acetic acid | 100 ml |
| Sodium sulphate | 200 g |
| Water to | 1 litre |

| Solution 7 | |
|---|---|
| Succinic acid | 100 g |
| Sodium sulphate | 50 g |
| Water to | 1 litre |

| Solution 8 | |
|---|---|
| Potassium iodide | 10 g |
| Sodium sulphate | 100 g |
| Water to | 1 litre |

| Solution 9 | |
|---|---|
| Acetic acid | 100 ml |
| Potassium iodide | 10 g |
| Sodium sulphate | 100 g |
| Water to | 1 litre |

The exposed material was dipped in the developer amplifier solution for 45 s, then removed. The material was laminated with the receiver sheet by running the developed material and the receiver sheet through a pair of stainless steel rollers. The two sheets were left in contact for a period of time and then stripped apart. Unless otherwise specified, the period of time was 5 minutes.

In order to test whether there was any residual CD3 present in the processed layer after stripping off the lamination sheet the following solution was applied:

| CD Testing Solution | |
|---|---|
| Sodium hydrogen carbonate | 10 g |
| Sodium carbonate | 10 g |
| Potassium hexacyanoferrate (III) | 5 g |
| Water to | 1 litre |

In areas where colour developing agent is retained a coloration is observed caused by the coupling of the residual colour developing agent with couplers in the coating in an unexposed region. The density of the treated patch was read through a blue filter and compared to the original Dmin.

A number of experiments were carried out to test the invention. This included some comparisons with processes with more traditional post-development process steps.

| process 1 (comparison) | | |
|---|---|---|
| Developer amplifier | 45 s | 35° C. |
| Stop bath | 45 s | 35° C. |
| Wash | 60 s | 35° C. |
| Dry | | |

| process 2 (comparison) | | |
|---|---|---|
| Developer amplifier | 45 s | 35° C. |
| Stop bath | 45 s | 35° C. |
| Bleach-fix | 45 s | 35° C. |
| Wash | 60 s | 35° C. |
| Dry | | |

| process 3 (invention) | | |
|---|---|---|
| Developer amplifier | 45 s | 35° C. |
| Laminate with carbon coating previously dipped for 5 s in solutions 1 to 7 temperature (20° C.) | 600 s | room |
| Dry | | |

| process 4 (comparison) | | |
|---|---|---|
| Developer amplifier | 45 s | 35° C. |
| Laminate with gelatin coating previously dipped for 5 s in solutions 1 to 7 temperature (20° C.) | 600 s | room |
| Dry | | |

The sensitometric results read as soon as possible after processing are shown in Table 1.

TABLE 1

| | | Dmin | | | Dmax | | | Contrast | | | Shoulder Contrast | | |
|---|---|---|---|---|---|---|---|---|---|---|---|---|---|
| Proc. | Soln. | R | G | B | R | G | B | R | G | B | R | G | B |
| 1 | — | 0.14 | 0.17 | 0.18 | 2.72 | 2.77 | 2.64 | 4.6 | 4.3 | 3.7 | 2.3 | 2.2 | 2.0 |
| 2 | — | 0.13 | 0.16 | 0.17 | 2.69 | 2.72 | 2.59 | 4.5 | 4.2 | 3.6 | 2.4 | 2.2 | 2.1 |
| 3 | 0 | 0.38 | 0.42 | 0.52 | 2.95 | 2.91 | 2.88 | 5.9 | 4.7 | 3.9 | 2.6 | 2.3 | 2.2 |
| 3 | 1 | 0.15 | 0.18 | 0.20 | 2.84 | 2.83 | 2.57 | 4.7 | 4.2 | 3.9 | 2.5 | 2.4 | 2.1 |
| 3 | 2 | 0.14 | 0.17 | 0.18 | 2.66 | 2.67 | 2.64 | 4.6 | 4.2 | 3.7 | 2.2 | 2.2 | 2.0 |

TABLE 1-continued

| | | Dmin | | | Dmax | | | Contrast | | | Shoulder Contrast | | |
|---|---|---|---|---|---|---|---|---|---|---|---|---|---|
| Proc. | Soln. | R | G | B | R | G | B | R | G | B | R | G | B |
| 3 | 3 | 0.14 | 0.17 | 0.17 | 2.70 | 2.74 | 2.63 | 4.6 | 4.0 | 3.7 | 2.3 | 2.2 | 2.0 |
| 3 | 4 | 0.14 | 0.17 | 0.19 | 2.70 | 2.78 | 1.88 | 4.6 | 4.1 | 3.7 | 2.3 | 2.2 | 2.0 |
| 3 | 5 | 0.14 | 0.17 | 0.19 | 2.72 | 2.72 | 2.63 | 4.8 | 4.3 | 3.7 | 2.2 | 2.2 | 2.0 |
| 3 | 6 | 0.17 | 0.22 | 0.22 | 2.70 | 2.65 | 2.59 | 4.6 | 4.3 | 3.6 | 2.3 | 2.2 | 2.0 |
| 3 | 7 | 0.16 | 0.20 | 0.22 | 2.78 | 2.76 | 2.67 | 4.5 | 4.0 | 3.8 | 2.3 | 2.2 | 2.0 |
| 3 | 8 | 0.14 | 0.17 | 0.20 | 2.69 | 2.73 | 2.62 | 4.6 | 4.2 | 3.6 | 2.3 | 2.2 | 2.0 |
| 3 | 9 | 0.14 | 0.17 | 0.20 | 2.73 | 2.74 | 2.66 | 4.6 | 4.3 | 3.6 | 2.1 | 2.2 | 2.0 |
| 4 | 1 | 0.15 | 0.18 | 0.20 | 2.84 | 2.83 | 2.57 | 4.7 | 4.2 | 3.9 | 2.5 | 2.4 | 2.1 |
| 4 | 2 | 0.14 | 0.17 | 0.18 | 2.66 | 2.67 | 2.64 | 4.6 | 4.2 | 3.7 | 2.2 | 2.2 | 2.0 |
| 4 | 3 | 0.14 | 0.17 | 0.17 | 2.70 | 2.74 | 2.63 | 4.6 | 4.0 | 3.7 | 2.3 | 2.2 | 2.0 |
| 4 | 4 | 0.14 | 0.17 | 0.19 | 2.70 | 2.78 | 1.88 | 4.6 | 4.1 | 3.7 | 2.3 | 2.2 | 2.0 |
| 4 | 5 | 0.14 | 0.17 | 0.19 | 2.72 | 2.72 | 2.63 | 4.8 | 4.3 | 3.7 | 2.2 | 2.2 | 2.0 |
| 4 | 6 | 0.17 | 0.22 | 0.22 | 2.70 | 2.65 | 2.59 | 4.6 | 4.3 | 3.6 | 2.3 | 2.2 | 2.0 |
| 4 | 7 | 0.16 | 0.20 | 0.22 | 2.78 | 2.76 | 2.67 | 4.5 | 4.0 | 3.8 | 2.3 | 2.2 | 2.0 |
| 4 | 8 | 0.14 | 0.17 | 0.20 | 2.69 | 2.73 | 2.62 | 4.6 | 4.2 | 3.6 | 2.3 | 2.2 | 2.0 |
| 4 | 9 | 0.14 | 0.17 | 0.20 | 2.73 | 2.74 | 2.66 | 4.6 | 4.3 | 3.6 | 2.1 | 2.2 | 2.0 |

The results show that lamination with a material that contains something to stop the development reaction is as good as the full process Table 2 shows the sensitometric results one week later after the strips had been kept in a south facing window.

TABLE 2

| | | Dmin | | | Dmax | | | Contrast | | | Shoulder Contrast | | |
|---|---|---|---|---|---|---|---|---|---|---|---|---|---|
| Proc. | Soln. | R | G | B | R | G | B | R | G | B | R | G | B |
| 1 | — | 0.15 | 0.18 | 0.19 | 2.74 | 2.78 | 2.64 | 4.6 | 4.3 | 3.8 | 2.3 | 2.2 | 2.0 |
| 2 | — | 0.13 | 0.16 | 0.17 | 2.69 | 2.72 | 2.59 | 4.5 | 4.2 | 3.6 | 2.4 | 2.2 | 2.1 |
| 3 | 0 | 0.46 | 0.48 | 0.59 | 3.00 | 2.96 | 3.00 | 5.9 | 4.6 | 3.9 | 2.5 | 2.1 | 2.2 |
| 3 | 1 | 0.16 | 0.18 | 0.20 | 2.84 | 2.80 | 2.58 | 4.6 | 4.2 | 3.8 | 2.5 | 2.4 | 2.1 |
| 3 | 2 | 0.15 | 0.17 | 0.18 | 2.66 | 2.67 | 2.64 | 4.6 | 4.2 | 3.8 | 2.2 | 2.2 | 2.0 |
| 3 | 3 | 0.14 | 0.17 | 0.17 | 2.71 | 2.74 | 2.63 | 4.7 | 4.0 | 3.7 | 2.3 | 2.1 | 2.0 |
| 3 | 4 | 0.15 | 0.18 | 0.20 | 2.74 | 2.75 | 1.86 | 4.5 | 4.1 | 3.8 | 2.2 | 2.2 | 2.0 |
| 3 | 5 | 0.15 | 0.18 | 0.20 | 2.72 | 2.74 | 2.64 | 4.8 | 4.4 | 3.7 | 2.2 | 2.2 | 2.0 |
| 3 | 6 | 0.19 | 0.23 | 0.23 | 2.73 | 2.68 | 2.63 | 4.7 | 4.3 | 3.6 | 2.3 | 2.3 | 2.0 |
| 3 | 7 | 0.18 | 0.22 | 0.24 | 2.80 | 2.78 | 2.66 | 4.6 | 4.0 | 3.8 | 2.4 | 2.2 | 2.0 |
| 3 | 8 | 0.14 | 0.17 | 0.20 | 2.69 | 2.74 | 2.62 | 4.6 | 4.3 | 3.6 | 2.3 | 2.2 | 2.0 |
| 3 | 9 | 0.14 | 0.17 | 0.19 | 2.73 | 2.74 | 2.65 | 4.6 | 4.3 | 3.6 | 2.1 | 2.2 | 2.0 |
| 4 | 1 | 0.17 | 0.22 | 0.25 | 2.86 | 2.86 | 2.59 | 4.7 | 4.2 | 3.9 | 2.5 | 2.4 | 2.1 |
| 4 | 2 | 0.16 | 0.23 | 0.25 | 2.68 | 2.69 | 2.69 | 4.6 | 4.2 | 3.7 | 2.2 | 2.2 | 2.0 |
| 4 | 3 | 0.15 | 0.21 | 0.24 | 2.73 | 2.75 | 2.64 | 4.6 | 4.0 | 3.7 | 2.3 | 2.2 | 2.0 |
| 4 | 4 | 0.16 | 0.22 | 0.24 | 2.72 | 2.80 | 1.91 | 4.6 | 4.1 | 3.7 | 2.3 | 22 | 2.0 |
| 4 | 5 | 0.16 | 0.22 | 0.24 | 2.75 | 2.75 | 2.65 | 4.8 | 4.3 | 3.7 | 2.2 | 2.2 | 2.0 |
| 4 | 6 | 0.19 | 0.27 | 0.27 | 2.73 | 2.68 | 2.61 | 4.6 | 4.3 | 3.6 | 2.3 | 2.2 | 2.0 |
| 4 | 7 | 0.20 | 0.25 | 0.27 | 2.80 | 2.78 | 2.69 | 4.5 | 4.0 | 3.8 | 2.3 | 2.2 | 2.0 |
| 4 | 8 | 0.17 | 0.22 | 0.25 | 2.70 | 2.76 | 2.66 | 4.6 | 4.2 | 3.6 | 2.3 | 2.2 | 2.0 |
| 4 | 9 | 0.17 | 0.20 | 0.24 | 2.74 | 2.76 | 2.69 | 4.6 | 4.3 | 3.6 | 2.1 | 2.2 | 2.0 |

The results show that the strips which were laminated to the carbon containing coatings had much less increase in Dmin on exposure to light and on keeping.

Table 3 shows the differences in Dmin after the CD test—this gives an indication of the retained CD3 and the likely amount of stain that might be produced on prolonged keeping.

TABLE 3

| Proc. | Solution | CD test density change |
|---|---|---|
| 1 | — | 0.03 |
| 2 | — | 0.02 |
| 3 | 0 | 0.95 |
| 3 | 1 | 0.02 |

TABLE 3-continued

| Proc. | Solution | CD test density change |
|---|---|---|
| 3 | 2 | 0.02 |
| 3 | 3 | 0.00 |
| 3 | 4 | 0.05 |
| 3 | 5 | 0.03 |
| 3 | 6 | 0.02 |
| 3 | 7 | 0.04 |
| 3 | 8 | 0.02 |
| 3 | 9 | 0.02 |
| 4 | 1 | 0.42 |
| 4 | 2 | 0.32 |
| 4 | 3 | 0.15 |
| 4 | 4 | 0.16 |
| 4 | 5 | 0.40 |
| 4 | 6 | 0.36 |
| 4 | 7 | 0.32 |
| 4 | 8 | 0.25 |
| 4 | 9 | 0.37 |

The results show that the carbon in the lamination sheet has removed the CD3. There appears to be some residual colour change in the coatings that have been through the whole process. The carbon lamination sheet coatings are not significantly worse than this even though some of the treatments are quite acidic i.e. CD3 might not be expected to adsorb well to carbon.

EXAMPLE 2

Photographic Coatings

Low silver photographic coatings were made on resin coated paper with a total silver laydown of 82 mg/m$^2$. Conventional couplers for colour paper photographic materials (see for example *Research Disclosure,* September 1997, Section II, p. 613) were used at their usual laydowns.

Preparation of Lamination Coatings

Coatings were made on subbed polyester base, the coating thickness being set to 100 $\mu$m. Table 4 shows the laydowns (g/m$^2$) of the components in the different coatings tested.

TABLE 4

| Lamination coating ID | Bone gel | Zinc powder | Aluminium powder | Darco 400-mesh carbon | Sodium thiosulphate |
|---|---|---|---|---|---|
| 1 | 10 | 0 | 0 | 0 | 0 |
| 2 | 10 | 0 | 0 | 10 | 0 |
| 3 | 10 | 10 | 0 | 0 | 0 |
| 4 | 10 | 10 | 0 | 0 | 5 |
| 5 | 10 | 0 | 10 | 0 | 0 |
| 6 | 10 | 0 | 10 | 0 | 5 |
| 7 | 10 | 10 | 0 | 10 | 0 |
| 8 | 10 | 0 | 10 | 10 | 0 |
| 9 | 10 | 10 | 0 | 10 | 5 |
| 10 | 10 | 0 | 10 | 10 | 5 |

Solutions

| Developer/amplifier | |
|---|---|
| Anti-Cal #5 | 0.5 g |
| Anti-Cal #8 | 0.8 g |
| dipotassium hydrogen phosphate | 40 g |
| hydroxylammonium sulphate (HAS) | 1.3 g |
| CD3 | 5.5 g |
| potassium chloride | 0.5 g |

-continued

| Developer/amplifier | |
|---|---|
| hydrogen peroxide (30%) | 2.7 g |
| water to | 1 litre |
| pH adjusted to 11.5 | |

| Stop | |
|---|---|
| acetic acid, glacial | 50 ml |
| water to | litre |

| Bleach-fix | |
|---|---|
| sodium thiosulphate | 50 g |
| sodium sulphite | 10 g |
| sodium iron (III) EDTA | 50 g |
| acetic acid | 10 ml |
| water to | litre |
| pH adjusted to 6.0 | |

| Soak solution 1 | |
|---|---|
| Acetic acid, glacial | 50 ml |
| Water to | 1 litre |

| Soak solution 2 | |
|---|---|
| Sodium carbonate | 25 g |
| Water to | 1 litre |

| Soak solution 3 | |
|---|---|
| Sodium thiosulphate | 50 g/l |
| Water to | 1 litre |

| CD test solution | |
|---|---|
| Potassium hexacyanoferrate (III) | 5 g |
| Sodium carbonate | 25 g |
| Water to | 1 litre |

| Silver halide test solution | |
|---|---|
| Sodium sulphide hydrated | 10 g |
| Water to | 1 litre |

Method

Unexposed paper was used for the test. The experiments were carried out in the dark.

The paper was processed in the developer amplifier bath for 45 s at 35° C. The paper was then laminated with a strip of lamination coating, at room temperature, which may have been dipped for 5 seconds in one of the soak solutions. The photographic material was stripped away from the lamination coating after a period of time.

The photographic material was then tested for the presence of residual colour developing agent and retained silver salts. The presence of the developing agent was tested by dropping two drops of the CD test solution from a dropper onto a small piece cut from the paper and waiting for 1 minute before washing off the excess for 2 minutes in clean water. The coating was allowed to dry and the density measured. This solution should react with any retained colour developing agent and form dye by coupling with the coupler present in the paper. To another piece of the processed paper, two drops of the silver halide test solution were applied from a dropper. After 2 minutes excess solution was removed by blotting with a tissue and the coating washed for 2 minutes.

The densities were compared to pieces of the photographic material that had had the tests applied but should contain no colour developing agent or silver halide prepared by the following process (carried out at 35° C.) (labelled check 1):

| | |
|---|---|
| Developer/amplifier | 45 s |
| Stop | 30 s |
| Bleach-fix | 45 s |
| Wash | 120 s |
| Dry | |

Results

The results of the CD test with lamination sheet 9 with a pre-soak in soak solution 1 are shown in Table 5.

TABLE 5

| | Lamination Time | | | | | |
|---|---|---|---|---|---|---|
| | 0 | 1 | 2 | 3 | 5 | Check 1 |
| Red | 1.41 | 0.20 | 0.21 | 0.21 | 0.18 | 0.20 |
| Green | 1.58 | 0.18 | 0.16 | 0.17 | 0.16 | 0.17 |
| Blue | 0.73 | 0.35 | 0.37 | 0.37 | 0.36 | 0.37 |

The results of the silver halide test with lamination sheet 9 with a pre-soak in soak solution 1 are shown in Table 6.

TABLE 6

| | Lamination Time (min) | | | | | |
|---|---|---|---|---|---|---|
| | 0 | 1 | 2 | 3 | 5 | Check 1 |
| Red | 0.29 | 0.10 | 0.09 | 0.09 | 0.1 | 0.10 |
| Green | 0.35 | 0.18 | 0.16 | 0.17 | 0.16 | 0.17 |
| BIue | 0.34 | 0.11 | 0.11 | 0.11 | 0.11 | 0.11 |

The results show that in less than one minute the lamination of the redox amplified photographic material with a coating containing carbon, zinc powder and thiosulphate, soaked in weak acid, resulted in the removal of the colour developing agent and silver halide.

The results for all the lamination coatings for retained colour developing agent are shown in Table 7. This only shows the red density after the test with 1-minute lamination time.

TABLE 7

| Lamination coating ID | Soak in water | Soak solution 1 | Soak solution 2 | Soak solution 3 | No soak |
|---|---|---|---|---|---|
| 1 | 1.01 | 0.88 | 1.03 | 0.99 | — |
| 2 | 0.23 | 0.22 | 0.22 | 0.21 | 0.50 |
| 3 | 1.11 | 1.00 | 1.05 | 1.04 | — |
| 4 | 1.05 | 0.95 | 1.01 | 0.95 | — |
| 5 | 0.99 | 0.99 | 0.96 | 0.96 | — |
| 6 | 1.05 | 1.01 | 0.95 | 0.96 | — |
| 7 | 0.20 | 0.19 | 0.23 | 0.22 | — |
| 8 | 0.19 | 0.19 | 0.20 | 0.21 | — |
| 9 | 0.21 | 0.20 | 0.25 | 0.20 | — |
| 10 | 0.20 | 0.21 | 0.19 | 0.20 | 0.45 |

The results show that all the laminations that contained carbon had most of the colour developing agent removed. There is some evidence that the coating containing zinc with an acid soak and the aluminium containing coating with an alkaline soak gave better colour developing agent removal in one minute. With no soak some of the colour developing agent was removed. After lamination, the pack was left for 5 minutes and the red densities of both examples fell to 0.20 suggesting that the coating were working but slower.

Table 8 shows the results of the silver halide test with the different lamination coatings and soak solutions. This only shows the red density after the test with 1 minute lamination time.

TABLE 8

| Lamination coating ID | Soak in water | Soak solution 1 | Soak solution 2 | Soak solution 3 | No soak |
|---|---|---|---|---|---|
| 1 | 0.29 | 0.30 | 0.29 | 0.19 | — |
| 2 | 0.28 | 0.30 | 0.28 | 0.16 | 0.29 |
| 3 | 0.30 | 0.25 | 0.30 | 0.19 | — |
| 4 | 0.24 | 0.10 | 0.22 | 0.22 | — |
| 5 | 0.29 | 0.24 | 0.30 | 0.21 | — |
| 6 | 0.23 | 0.23 | 0.10 | 0.20 | — |
| 7 | 0.29 | 0.28 | 0.23 | 0.22 | — |
| 8 | 0.28 | 0.29 | 0.25 | 0.21 | — |
| 9 | 0.29 | 0.10 | 0.25 | 0.17 | — |
| 10 | 0.24 | 0.25 | 0.11 | 0.22 | 0.45 |

The results show that the silver salts are removed from the coating where there is a fixing agent present e.g. thiosulphate and a metal in a solution that will produce 'nascent hydrogen' which might be described as a strongly reducing medium.

Lamination coatings containing both carbon and metal in a suitable acid or alkaline environment removed both residual colour developing agent and silver halide from the low silver photographic material.

EXAMPLE 3

Photographic Coatings

A conventional Kodak EKTACOLOR Edge 2 coating was used with a total silver laydown of about 600 mg/m$^2$.

Solutions

The solutions used in example 2 were used in this example with the exception of the developer amplifier. This was replaced with a conventional developer: Kodak EKTACOLOR Prime.

Results

The results of the CD test with lamination sheet 9 with a pre-soak in soak solution 1 are shown in Table 9.

TABLE 9

| | Lamination Time (min) | | | | | |
|---|---|---|---|---|---|---|
| | 0 | 1 | 2 | 3 | 5 | Check 1 |
| Red | 1.5 | 0.21 | 0.20 | 0.21 | 0.19 | 0.20 |
| Green | 1.68 | 0.20 | 0.18 | 0.18 | 0.18 | 0.19 |
| Blue | 0.94 | 0.35 | 0.36 | 0.37 | 0.35 | 0.35 |

The results of the silver halide test with lamination sheet 10 with a pre-soak in soak solution 2 are shown in Table 10.

TABLE 10

| | Lamination Time (min) | | | | | |
|---|---|---|---|---|---|---|
| | 0 | 2 | 4 | 6 | 8 | 10 |
| Red | 1.09 | 0.35 | 0.27 | 0.15 | 0.12 | 0.1 |
| Green | 1.21 | 0.47 | 0.36 | 0.22 | 0.17 | 0.15 |
| Blue | 1.23 | 0.63 | 0.47 | 0.27 | 0.17 | 0.14 |

The results show that in less than one minute the lamination of the redox amplified photographic material with a coating containing carbon, aluminium powder and thiosulphate, soaked in a weak alkali, resulted in the removal of the colour developing agent and silver halide.

EXAMPLE 4

Example 2 was repeated but using a lamination sheet which had a laydowns of 10 g/m$^2$ carbon, 10 g/m$^2$ zinc powder, 10 g/m$^2$ gelatin and 5 g/m$^2$ hydroxyethyletrahydrotriazole thione (HTTT). The results for the colour developer test are shown in Table 11 and the silver halide test in Table 12.

TABLE 11

| | Lamination Time (min) | | | | | |
|---|---|---|---|---|---|---|
| | 0 | 1 | 2 | 3 | 5 | Check 1 |
| Red | 1.43 | 0.21 | 0.19 | 0.21 | 0.19 | 0.20 |
| Green | 1.52 | 0.17 | 0.18 | 0.17 | 0.17 | 0.17 |
| Blue | 0.78 | 0.35 | 0.35 | 0.35 | 0.36 | 0.37 |

TABLE 12

| | Lamination Time (min) | | | | | |
|---|---|---|---|---|---|---|
| | 0 | 1 | 2 | 3 | 5 | Check 1 |
| Red | 0.29 | 0.11 | 0.09 | 0.09 | 0.09 | 0.10 |
| Green | 0.34 | 0.17 | 0.17 | 0.17 | 0.16 | 0.17 |
| Blue | 0.34 | 0.11 | 012 | 0.11 | 0.11 | 0.11 |

The results are very similar to the results shown in Tables 2 and 3 showing that HTTT can be used to replace thiosulphate as the fixing agent implying that any fixing agent would be suitable. This might be coated or in the lamination sheet soak solution.

What is claimed is:

1. A method of producing a photographic image in an imagewise exposed photographic material comprising one or more silver halide emulsion layers which method comprises developing the material by passing it through a developer solution containing a silver halide developing agent, releasably laminating the material with a receiver sheet containing an adsorbent for the developing agent in oxidised and unoxidised form, and, after a period of time sufficient for adsorption of the developing agent in the receiver sheet, separating the photographic material and the receiver sheet.

2. A method according to claim 1 wherein the adsorbent for the developing agent is carbon.

3. A method according to claim 1 wherein the receiver sheet contains a compound capable of solubilising silver halide.

4. A method according to claim 3 wherein the compound capable of solubilising silver halide is a thiosulphate.

5. A method according to claim 3 wherein the compound capable of solubilising silver halide is hydroxyethyletrahydrotriazole thione.

6. A method according to claim 1 wherein the receiver sheet contains a substance capable of converting soluble silver into an insoluble form.

7. A method according to claim 6 wherein the substance capable of converting soluble silver into an insoluble form is metallic aluminium or zinc.

8. A method according to claim 6 wherein the substance capable of converting soluble silver into an insoluble form is zinc sulphide.

9. A method according to claim 1 wherein the receiver sheet is soaked in an aqueous solution before lamination.

10. A method according to claim 1 wherein the developing agent is a chromogenic colour developing agent.

11. A method according to claim 1 wherein the development is carried out using a redox amplification process.

* * * * *